US008281634B2

(12) United States Patent
Hawkes

(10) Patent No.: US 8,281,634 B2
(45) Date of Patent: Oct. 9, 2012

(54) CONTINUOUS EXTRUSION APPARATUS AND METHOD FOR THE PRODUCTION OF CABLE HAVING A CORE SHEATHED WITH ALUMINUM BASED SHEATH WITH A CONTINUOUS EXTRUSION APPARATUS

(75) Inventor: Daniel John Hawkes, Shadoxhurst (GB)

(73) Assignee: BWE Limited, Kent, England (GB)

( * ) Notice: Subject to any disclaimer, the term of this patent is extended or adjusted under 35 U.S.C. 154(b) by 276 days.

(21) Appl. No.: 12/654,136

(22) Filed: Dec. 11, 2009

(65) Prior Publication Data

US 2010/0163270 A1 Jul. 1, 2010

Related U.S. Application Data

(63) Continuation of application No. PCT/GB2008/001754, filed on May 23, 2008.

(30) Foreign Application Priority Data

Jun. 13, 2007 (GB) ..... 0711410.1

(51) Int. Cl.
*B21C 23/00* (2006.01)
*B21C 25/00* (2006.01)

(52) U.S. Cl. ..... 72/262; 72/256; 72/258; 72/268

(58) Field of Classification Search ..... 72/441–443, 72/256, 262, 264, 268–270, 258
See application file for complete search history.

(56) References Cited

U.S. PATENT DOCUMENTS 2,105,083 A 1/1938 Kagi et al.
2,869,220 A 1/1959 Raydt et al.
3,572,074 A 3/1971 Holdup et al.
3,732,717 A 5/1973 Ahlvers
4,407,621 A * 10/1983 Hansen ..... 414/433
(Continued)

FOREIGN PATENT DOCUMENTS

EP 0 202 953 A2 11/1986
(Continued)

OTHER PUBLICATIONS

Written Opinion of the International Searching Authority of PCT/GB2008/001754 dated Aug. 11, 2008, 8 pgs.
(Continued)

*Primary Examiner* — Dana Ross
*Assistant Examiner* — Pradeep C Battula
(74) *Attorney, Agent, or Firm* — Shlesinger, Arkwright & Garvey LLP

(57) ABSTRACT

Apparatus for continuous extrusion of an aluminum sheathing on to a core cable includes a rotatable wheel formed with two identical circumferential grooves outwardly bounded by arcuate tooling discharging through radial exit apertures to an extrusion chamber positioned around a portal mandrel. A powered pay-off reel is arranged continuously to supply core cable through the mandrel while aluminum sheathing is extruded as a loose fit from extrusion chamber around the core cable. The extruded cable is discharged through cooling device to roller corrugator including a rotating frame mounted on carriage freely moveable axially of the cable and provided with a rotational drive having a roller arranged to form a continuous helical indentation in the sheathing. Pneumatic actuating cylinders positioned on the carriage provide a constant, low magnitude, tension on the portion of the sheath intermediate the extrusion chamber and roller corrugator and limit forces tending to distort the uncooled sheath.

8 Claims, 1 Drawing Sheet

U.S. PATENT DOCUMENTS

| | | | | |
|---|---|---|---|---|
| 4,564,347 | A | 1/1986 | Vaughan | |
| 5,152,163 | A | 10/1992 | Hawkes et al. | |
| 5,197,319 | A | 3/1993 | Beekel et al. | |
| 5,628,221 | A * | 5/1997 | Pardi et al. | 72/187 |
| 5,829,298 | A | 11/1998 | Linsenbardt et al. | |
| 5,836,191 | A | 11/1998 | Wright | |
| 6,988,389 | B2 | 1/2006 | Hawkes | |
| 7,194,885 | B2 | 3/2007 | Hawkes | |
| 7,980,110 | B2 * | 7/2011 | Hawkes | 72/262 |
| 2005/0268682 | A1 | 12/2005 | Hawkes | |
| 2006/0156782 | A1 | 7/2006 | Hawkes | |
| 2008/0118595 | A1 | 5/2008 | Hawkes | |

FOREIGN PATENT DOCUMENTS

| | | | |
|---|---|---|---|
| WO | WO 2006/043069 | A | 4/2006 |

OTHER PUBLICATIONS

International Search Report of PCT/GB2008/001754 dated Aug. 11, 2008, 3 pgs.

Publication No. JP 56139222 A, dated Oct. 30, 1981, English Abstract of JP 59011366 B, (1 pg.).

* cited by examiner

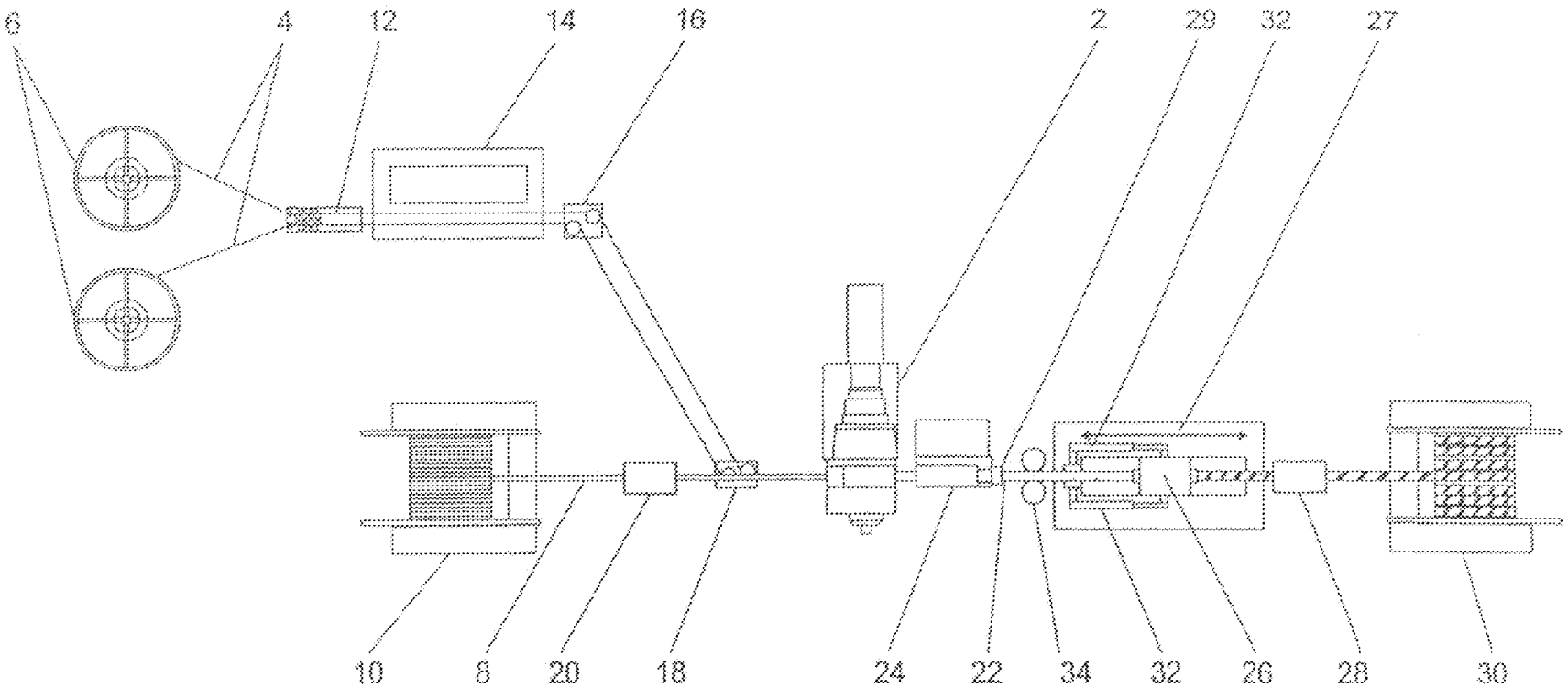
6
4
12
14
16
2
29
32
27
10
8
20
18
24
22
34
32
26
28
30

CONTINUOUS EXTRUSION APPARATUS AND METHOD FOR THE PRODUCTION OF CABLE HAVING A CORE SHEATHED WITH ALUMINUM BASED SHEATH WITH A CONTINUOUS EXTRUSION APPARATUS

CROSS-REFERENCE TO RELATED APPLICATIONS

This application is a continuation of application no. PCT/GB2008/001754, filed 23 May 2008, which claims the priority of United Kingdom patent application no. 0711410.1, filed 13 Jun. 2007, and each of which is incorporated herein by reference.

FIELD OF THE INVENTION

This invention relates to apparatus and method for the production of cable having a core sheathed with aluminium based sheath.

BACKGROUND OF THE INVENTION

WO2006/043069 Al discloses continuous extrusion apparatus having a rotatable wheel formed with two identical circumferential grooves outwardly bounded by arcuate tooling discharging through radial exit apertures to an extrusion chamber positioned around a portal mandrel and means arranged continuously to supply a core through the mandrel whilst aluminium based sheathing is extruded from the extrusion chamber around the core to form a cable being discharged to a roller corrugator arranged to form a helical corrugation on the sheath.

OBJECTS AND SUMMARY OF THE INVENTION

It is an object of the present invention to overcome the drawbacks of the prior art.

According to the present invention, the roller corrugator is provided with rotational drive means and is mounted upon a freely axially moveable carriage with actuating means positioned on the carriage and arranged to apply a force on the sheath in a direction longitudinally of the cable to regulate tension in the sheath intermediate the extrusion chamber and the roller corrugator to a constant, low magnitude, value.

Preferably, the carriage is maintained at a predetermined position longitudinally of the cable.

Suitably the speed of the rotational drive means of the roller corrugator is controlled in accordance with a signal indicative of the linear speed of the sheath combined with a signal from a transducer indicative of the position of the carriage.

The invention also includes the method of producing a cable having a core sheathed with an aluminium based sheath whereby a core is supplied to a portal mandrel of continuous extrusion apparatus and aluminium based feedstock is extruded at a temperature of approximately 500° Celsius at an extrusion chamber surrounding the portal mandrel to form a cable discharging from the continuous extrusion apparatus through cooling means to reduce the sheath temperature to approximately 50° Celsius to a roller corrugator mounted on a carriage and arranged to form a helical corrugation in the sheath, the carriage being freely moveable axially of the cable and utilising actuating means positioned on the carriage to apply a force on the sheath in a direction longitudinally of the cable to regulate the tension in the sheath intermediate the extrusion chamber and the cooling means.

The invention further includes apparatus for continuous extrusion of an aluminium sheathing on to a core cable and includes a rotatable wheel formed with two identical circumferential grooves outwardly bounded by arcuate tooling discharging through radial exit apertures to an extrusion chamber positioned around a portal mandrel. A powered pay-off reel is arranged continuously to supply the core cable through the mandrel whilst the aluminium sheathing is extruded as a loose fit from the extrusion chamber around the core cable. The extruded cable is discharged through cooling device to a roller corrugator including a rotating frame mounted on a carriage freely moveable axially of the cable and provided with a rotational drive having a roller arranged to form a continuous helical indentation in the sheathing. Pneumatic actuating cylinders are positioned on the carriage to provide a constant, low magnitude, tension on the portion of the sheath intermediate the extrusion chamber and the roller corrugator and limit forces tending to distort the uncooled sheath. A pair of opposed grooved rollers are provided upstream of the roller corrugator to restrict transmission upstream of any torsional forces arising from the roller corrugator. The rotational speed of the rotating frame of the roller corrugator is regulated in accordance with the linear speed of the cable to effect transport of the cable without causing unacceptable stretching of the sheath.

Relative terms such as up, down, left, and right are for convenience only and are not intended to be limiting.

BRIEF DESCRIPTION OF THE DRAWING

The FIGURE shows an outline plan view of the invention.

DETAILED DESCRIPTION OF THE INVENTION

The invention will now be described, by way of example, with reference to the accompanying outline plan view of an assembly for the production of cable having an aluminium based sheath positioned around an insulated core conductor, showing a continuous extrusion apparatus 2, such as the apparatus described in WO2006/043069 Al, arranged to receive an aluminium based feedstock 4 from pay-off reels 6 and core conductor 8 from a powered pay-off reel 10. The aluminium based feedstock 4 passes through straightening means 12, a feedstock cleaning system 14 and diverting rolls 16, 18 to circumferential grooves discharging to a portal die extrusion chamber in the continuous extrusion apparatus 2. The core conductor 8, generally having a diameter of 45 to 190 mm, is fed through an ultrasonically actuated vertical position sensor 20 to the central bore of the portal mandrel of the continuous extrusion apparatus 2.

At the continuous extrusion apparatus 2, the aluminium based feedstock 4 is extruded at a temperature at the extrusion chamber of approximately 500° Celsius as a loose co-axial sheath generally having a wall thickness in the range of 1 to 4 mm and diameter in the range of 50 to 200 mm around the core conductor 8 to form a cable 22 and, upon exit from the continuous extrusion apparatus 2, the sheath is rapidly cooled to approximately 50° Celsius in cooling means 24. The cable 22 is discharged from the cooling means 24 to a powered roller corrugator 26, an ultrasonically actuated vertical position sensor 28 and a powered take-up reel 30 driven in accordance with a signal derived from the position sensor 28 combined with a signal derived from a speed transducer positioned at the exit of the cooling means 24.

The powered roller corrugator 26 includes one or more rollers mounted on a frame through the corrugator. The speed of rotation of the frame is regulated in accordance with the linear speed of the cable 22 as sensed at the speed transducer 29 at the exit of the cooling means 24.

The roller corrugator 26 is mounted on a carriage 27 freely moveable axially of the cable 22 by virtue of axial forces generated by the inter-action of the inclined roller with the sheath with the rotational speed of the frame being controlled in order to bias the position of the carriage 27 toward a mid-point of travel whilst imposing a low inertia controllable force on the sheath of sufficient magnitude as to effect transport of the cable without causing unacceptable stretching of the sheath.

Pneumatic actuating cylinders 32 having frictionless seals are positioned on the roller corrugator carriage 27 to provide a constant, low magnitude, tension on the portion of the sheath intermediate the extrusion chamber and the cooling means 24 regardless of the position of the roller corrugator.

A pair of opposed grooved rollers 34 are provided upstream of the corrugator 26 with the grooves lined with resilient material profiled to the circumference of the sheath to restrict transmission of any torsional forces imposed on the sheath by the corrugator from being transmitted in the sheath back to the portion of sheath adjacent the extrusion chamber.

In operation, the continuous extrusion apparatus 2 is supplied with aluminium feedstock 4 and a conductor core 8 and is operated to extrude a loose fit sheath around the conductor to form a cable 22 with the conductor core 8 supply being controlled in accordance with a signal derived from the speed transducer 29 mounted at the exit of the cooling means 24 combined with a signal derived from the ultrasonically actuated vertical position sensor 20.

Since, at the extrusion temperature of approximately 500° Celsius, the aluminium based sheathing has little strength, by imposing a constant, low magnitude, tension on the portion of the sheath intermediate the extrusion chamber and the cooling means 24 any forces tending to distort the uncooled sheath portion are avoided and it is possible to maintain a substantially constant wall thickness and avoid discontinuities in the sheath.

Caterpillar haul-offs (not shown) may be positioned to engage with the core conductor 8 upstream of the continuous extrusion apparatus 2 and with the sheath downstream of the continuous extrusion apparatus 2 in order to facilitate starting up and shutting down of the apparatus.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. Continuous extrusion apparatus, comprising:

a) having a rotatable wheel formed with two identical circumferential grooves outwardly bounded by arcuate tooling discharging through radial exit apertures to an extrusion chamber positioned around a portal mandrel and means arranged continuously to supply a core through the mandrel whilst an aluminium based sheathing is extruded from the extrusion chamber around the core to form a cable being discharged to a roller corrugator arranged to form a helical corrugation on the sheath, wherein the roller corrugator is provided with rotational drive means and is mounted upon a freely axially moveable carriage with actuating means positioned on the carriage to apply a force on the sheath in a direction longitudinally of the cable to regulate tension in the sheath intermediate the extrusion chamber and the roller corrugator to a constant, low magnitude, value; and b) the speed of the rotational drive means of the roller corrugator is controlled in accordance with a signal indicative of the linear speed of the sheath combined with a signal from a transducer indicative of the position of the carriage.

2. Continuous extrusion apparatus as claimed in claim 1, wherein:

a) the actuating means are arranged to bias the carriage towards a predetermined position longitudinally of the cable.

3. Continuous extrusion apparatus, comprising:

a) a rotatable wheel, the rotatable wheel including two identical circumferential grooves outwardly bounded by arcuate tooling discharging through radial exit apertures to an extrusion chamber positioned around a portal mandrel and a device configured to continuously supply a core through the mandrel as an aluminium based sheathing is extruded from the extrusion chamber around the core to form a cable being discharged to a roller corrugator arranged and configured to form a helical corrugation on the sheath;

b) the roller corrugator being provided with a rotational drive device and being mounted upon a freely axially moveable carriage with an actuating device configured for and positioned on the carriage to apply a force on the sheath in a direction longitudinally of the cable to regulate tension in the sheath intermediate the extrusion chamber and the roller corrugator to a constant, low magnitude, value; and c) the speed of the rotational drive device of the roller corrugator is controlled in accordance with a signal indicative of the linear speed of the sheath combined with a signal from a transducer indicative of the position of the carriage.

4. Continuous extrusion apparatus as in claim 3, wherein:

a) the actuating device is configured and provided to bias the carriage towards a predetermined position longitudinally of the cable.

5. Continuous extrusion apparatus, comprising:

a) having a rotatable wheel formed with two identical circumferential grooves outwardly bounded by arcuate tooling discharging through radial exit apertures to an extrusion chamber positioned around a portal mandrel and means arranged continuously to supply a core through the mandrel whilst an aluminium based sheathing is extruded from the extrusion chamber around the core to form a cable being discharged to a roller corrugator arranged to form a helical corrugation on the sheath, wherein the roller corrugator is provided with rotational drive means and is mounted upon a freely axially moveable carriage with actuating means positioned on the carriage to apply a force on the sheath in a direction longitudinally of the cable to regulate tension in the sheath intermediate the extrusion chamber and the roller corrugator to a constant, low magnitude, value; and b) a pair of opposed grooved rollers are provided upstream of the roller corrugator and are adapted to restrict transmission upstream of any torsional forces arising from the roller corrugator.

6. Continuous extrusion apparatus as claimed in claim 5, wherein:

a) the actuating means are arranged to bias the carriage towards a predetermined position longitudinally of the cable.

7. Continuous extrusion apparatus, comprising:

a) a rotatable wheel, the rotatable wheel including two identical circumferential grooves outwardly bounded by arcuate tooling discharging through radial exit apertures to an extrusion chamber positioned around a portal mandrel and a device configured to continuously supply a core through the mandrel as an aluminium based sheathing is extruded from the extrusion chamber around the core to form a cable being discharged to a roller corrugator arranged and configured to form a helical corrugation on the sheath;

b) the roller corrugator being provided with a rotational drive device and being mounted upon a freely axially moveable carriage with an actuating device configured for and positioned on the carriage to apply a force on the sheath in a direction longitudinally of the cable to regulate tension in the sheath intermediate the extrusion chamber and the roller corrugator to a constant, low magnitude, value; and c) a pair of opposed grooved rollers is provided upstream of the roller corrugator and configured for restricting transmission upstream of any torsional forces arising from the roller corrugator.

8. Continuous extrusion apparatus as in claim 7, wherein:

a) the actuating device is configured and provided to bias the carriage towards a predetermined position longitudinally of the cable.

* * * * *